US010584577B2

(12) United States Patent
Tiss et al.

(10) Patent No.: US 10,584,577 B2
(45) Date of Patent: Mar. 10, 2020

(54) IN-SITU RESERVOIR DEPLETION MANAGEMENT BASED ON SURFACE CHARACTERISTICS OF PRODUCTION

(71) Applicant: Saudi Arabian Oil Company, Dhahran (SA)

(72) Inventors: Meftah Y. Tiss, Dhahran (SA); Amjad H. Ashri, Dhahran (SA); Abdullah A. Al-Utaibi, Dhahran (SA); AbdulRahman M. Al-Nutaifi, Dhahran (SA); Bestman Somiari, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 113 days.

(21) Appl. No.: 15/919,491

(22) Filed: Mar. 13, 2018

(65) Prior Publication Data

US 2019/0284926 A1 Sep. 19, 2019

(51) Int. Cl.

| | |
|---|---|
| ***E21B 43/12*** | (2006.01) |
| ***E21B 47/06*** | (2012.01) |
| ***E21B 43/16*** | (2006.01) |
| ***E21B 47/00*** | (2012.01) |
| ***E21B 43/00*** | (2006.01) |

(52) U.S. Cl.

CPC ..... *E21B 47/06* (2013.01); *E21B 43/00* (2013.01); *E21B 43/12* (2013.01); *E21B 43/123* (2013.01); *E21B 43/16* (2013.01); *E21B 47/0003* (2013.01)

(58) Field of Classification Search

CPC ..... E21B 47/06; E21B 47/0003; E21B 43/16; E21B 43/123

See application file for complete search history.

(56) References Cited

U.S. PATENT DOCUMENTS 6,101,447 A * 8/2000 Poe, Jr. ..... E21B 49/00 702/13

6,693,553 B1 2/2004 Ciglenec et al.

(Continued)

OTHER PUBLICATIONS

Chiu, K., et al.; "Modeling of Wellbore Heat Losses in Directional Wells Under Changing Injection Conditions" SPE 22870; 66th Annual Technical Conference and Exhibition of the Society of Petroleum Engineers, Dallas, TX, Oct. 6-9, 1991; pp. 517-528.

(Continued)

*Primary Examiner* — Brad Harcourt

(74) *Attorney, Agent, or Firm* — Bracewell LLP; Constance G. Rhebgergen; Christopher L. Drymalla

(57) ABSTRACT

Provided are systems and methods of hydrocarbon well monitoring, assessment and development including: obtaining wellhead production data for a well; determining, based on the wellhead production data for the well, observed constant wellhead production rates for the well; for each of the observed constant wellhead production rates, determining a corresponding wellhead pressure and a cumulative production volume for each occurrence of the observed wellhead production rate, and a depletion rate for the observed constant wellhead production rate; determining, based on the depletion rates for the observed constant wellhead production rates, a depletion rate for the well that is indicative of a change in a flowing wellhead pressure of the well as a function of production volume of the well. Embodiments include undertaking well and reservoir development operations based on the depletion rate determined for the well.

20 Claims, 6 Drawing Sheets

(56) References Cited

U.S. PATENT DOCUMENTS

| | | | |
|---|---|---|---|
| 8,078,328 | B2 | 12/2011 | Malki et al. |
| 8,280,635 | B2 | 10/2012 | Ella et al. |
| 8,898,017 | B2 | 11/2014 | Kragas et al. |
| 8,935,100 | B2 | 1/2015 | Weiner et al. |
| 9,268,057 | B2 | 2/2016 | Abitrabi et al. |
| 9,399,901 | B2 | 7/2016 | Poe |
| 9,423,526 | B2 | 8/2016 | Abitrabi et al. |
| 9,423,552 | B2 | 8/2016 | Richards et al. |
| 2013/0043031 | A1 | 2/2013 | Tunget |
| 2013/0245953 | A1 | 9/2013 | Gonzales et al. |
| 2016/0305238 | A1 | 10/2016 | Gottumukkala et al. |

OTHER PUBLICATIONS

Cullender. M.H., et al.; "Practical Solution of Gas-Flow Equations for Wells and Pipelines with Large Temperature Gradients" SPE 696-G; Petroleum Branch Fall Meeting, Los Angeles, Oct. 11-17, 1956; pp. 281-287.

Dall'Olio, D., et al.; "Well Head Test Analysis: Save and Safe" SPE 39971; SPE Gas Technology Symposium, Calgary, AB, Mar. 15-18, 1998; pp. 139-143.

Mattar, L., et al.; "The 'Flowing' Material Balance Procedure" Paper 95-77; 46th Annual Technical Meeting of the Petroleum Society of CIM, Banff, AB, May 14-17, 1995; 13 pages.

Oden, R.D., et al.; "Modification of the Cullender and Smith Equation for More Accurate Bottomhole Pressure Calcuations in Gas Wells" SPE 17306; SPE Permian Basil Oil and Gas Recovery Conference, Midland, TX, Mar. 10-11, 1988; pp. 311-320.

Rzasa, M. J., et al.; "Calculation of Static Pressure Gradients in Gas Wells" American Institute of Mining and Metallurgical Engineers, New York Meeting, Feb. 1945, pp. 100-113.

Sukkar, Yusuf K., et al.; "Direct Calculation of Bottom-Hole Pressure in Natural Gas Wells" SPE 439-G; Petroleum Transactions AIME vol. 204, 1955; pp. 43-48.

Young, Keith L.; "Effect of Assumptions Used to Calculate Bottom-Hole Pressures in Gas Wells" SPE 1626; SPE Gas Technology Symposium, Omaha, NB, Sep. 15-16, 1966; 4 pages.

* cited by examiner

300

| Wellhead Production Data for Well-A | | | |
|---|---|---|---|
| Initial Reservoir Pressure = 6000 psi | | | |
| Date | Observed Production Rate (MMSCFD) | Average Wellhead Pressure (psi) | Cumulative Production (MMSCF) |
| 7/7/15 | 10 | 5000 | 10 |
| 7/8/15 | 15 | 4279 | 25 |
| 7/9/15 | 20 | 3393 | 45 |
| 7/10/15 | 10 | 4950 | 55 |
| 7/11/15 | 15 | 4214 | 70 |
| 7/12/15 | 20 | 3326 | 90 |
| 7/13/15 | 10 | 4901 | 100 |
| 7/14/15 | 15 | 4151 | 115 |
| 7/15/15 | 20 | 3259 | 135 |
| 7/16/15 | 10 | 4851 | 145 |
| 7/17/15 | 15 | 4089 | 160 |
| 7/18/15 | 20 | 3194 | 180 |
| 7/19/15 | 10 | 4803 | 190 |
| 7/20/15 | 15 | 4028 | 205 |
| 7/21/15 | 20 | 3130 | 225 |
| 7/22/15 | 10 | 4755 | 235 |
| 7/23/15 | 15 | 3967 | 250 |
| 7/24/15 | 20 | 3067 | 270 |
| 7/25/15 | 10 | 4707 | 280 |
| 7/26/15 | 15 | 3908 | 295 |
| 7/27/15 | 20 | 3006 | 315 |
| 7/28/15 | 10 | 4660 | 325 |
| 7/29/15 | 15 | 3849 | 340 |
| 7/30/15 | 20 | 2946 | 360 |
| 7/31/15 | 10 | 4614 | 370 |
| 8/1/15 | 15 | 3791 | 385 |
| 8/2/15 | 20 | 2887 | 405 |
| 8/3/15 | 10 | 4568 | 415 |
| 8/4/15 | 15 | 3734 | 430 |
| 8/5/15 | 20 | 2829 | 450 |
| 8/6/15 | 10 | 4522 | 460 |
| 8/7/15 | 15 | 3678 | 475 |
| 8/8/15 | 20 | 2773 | 495 |
| 8/9/15 | 10 | 4477 | 505 |
| 8/10/15 | 15 | 3623 | 520 |
| 8/11/15 | 20 | 2717 | 540 |
| 8/12/15 | 10 | 4432 | 550 |
| 8/13/15 | 15 | 3569 | 565 |
| 8/14/15 | 20 | 2663 | 585 |
| 8/15/15 | 10 | 4388 | 595 |
| 8/16/15 | 15 | 3515 | 610 |
| 8/17/15 | 20 | 2610 | 630 |
| 8/18/15 | 10 | 4344 | 640 |
| 8/19/15 | 15 | 3463 | 655 |
| 8/20/15 | 5 | 5200 | 660 |
| 8/21/15 | 20 | 2557 | 680 |

FIG. 3A

302a

| Data for Observed Production Rate of 10 (MMSCFD) | |
|---|---|
| Cumulative Production (MMSCF) | Average Wellhead Pressure (psi) |
| 10 | 5000 |
| 55 | 4950 |
| 100 | 4900.5 |
| 145 | 4851.495 |
| 190 | 4802.98005 |
| 235 | 4754.95025 |
| 280 | 4707.400747 |
| 325 | 4660.32674 |
| 370 | 4613.723472 |
| 415 | 4567.586237 |
| 460 | 4521.910375 |
| 505 | 4476.691271 |
| 550 | 4431.924359 |
| 595 | 4387.605115 |
| 640 | 4343.729064 |
| **Depletion Rate (psi/MMSCF)** | **-1.041426453** |

FIG. 3B

302b

| Data for Observed Production Rate of 15 (MMSCFD) | |
|---|---|
| Cumulative Production (MMSCF) | Average Wellhead Pressure (psi) |
| 25 | 4278.573128 |
| 70 | 4214.394531 |
| 115 | 4151.178613 |
| 160 | 4088.910934 |
| 205 | 4027.57727 |
| 250 | 3967.163611 |
| 295 | 3907.656157 |
| 340 | 3849.041314 |
| 385 | 3791.305695 |
| 430 | 3734.436109 |
| 475 | 3678.419567 |
| 520 | 3623.243274 |
| 565 | 3568.894625 |
| 610 | 3515.361205 |
| 655 | 3462.630787 |
| **Depletion Rate (psi/MMSCF)** | **-1.294378213** |

FIG. 3C

302c

| Data for Observed Production Rate of 20 (MMSCFD) | |
|---|---|
| Cumulative Production (MMSCF) | Average Wellhead Pressure (psi) |
| 45 | 3393.378172 |
| 90 | 3325.510608 |
| 135 | 3259.000396 |
| 180 | 3193.820388 |
| 225 | 3129.94398 |
| 270 | 3067.345101 |
| 315 | 3005.998199 |
| 360 | 2945.878235 |
| 405 | 2886.96067 |
| 450 | 2829.221457 |
| 495 | 2772.637028 |
| 540 | 2717.184287 |
| 585 | 2662.840601 |
| 630 | 2609.583789 |
| 675 | 2557.392113 |
| **Depletion Rate (psi/MMSCF)** | **-1.325556538** |

FIG. 3D

142

| Well-A Depletion Analysis Data | | |
|---|---|---|
| Observed Production Rate | Occurences | Depletion Rate |
| 10 | 15 | -1.041426453 |
| 15 | 15 | -1.294378213 |
| 20 | 15 | -1.325556538 |
| **Average/Well Depletion Rate (psi/MMSCF)** | | **-1.22** |
| **Max Depletion Rate (psi/MMSCF)** | | **-1.33** |
| **Min Depletion Rate (psi/MMSCF)** | | **-1.04** |
| **Well Depletion (psi)** | | **-830** |
| **Resulting Reservoir Pressure (psi)** | | **5170** |

FIG. 3E

IN-SITU RESERVOIR DEPLETION MANAGEMENT BASED ON SURFACE CHARACTERISTICS OF PRODUCTION

FIELD

Embodiments relate generally to hydrocarbon reservoir management and more particularly to in-situ reservoir depletion management based on surface characteristics of production.

BACKGROUND

Wells are typically operated to extract natural resources, such as hydrocarbons, from rock formations beneath the Earth's surface. A hydrocarbon well typically includes a bored hole that extends into a rock formation located beneath the Earth's surface that contains, or is at least expected to contain, hydrocarbons, such as oil and gas. The bored hole is often referred to as a "wellbore", the rock formation is often referred to as a "subsurface formation", and the portion of the subsurface formation that contains (or is at least expected to contain) hydrocarbons is often referred to as a "hydrocarbon reservoir" or simply a "reservoir". For a hydrocarbon production well, primary production refers to hydrocarbons that are recovered naturally from the well. During the development of a hydrocarbon production well, various operations can be taken to facilitate the recovery of hydrocarbons. These can include general management of the flow of production from the well, and Enhanced Oil Recovery (EOR) operations to improve the recovery of hydrocarbons from the well. One form of EOR is an injection operation. This can include injecting a substance, such as water or gas, into a subsurface formation to urge production to flow from the reservoir, into a production well. Such an injection operation may be conducted, for example, by way of an injection well near a production well, to force hydrocarbons toward and into the wellbore of the production well. Over the life of a hydrocarbon production well an operator may monitor and assess characteristics of the well and an associated reservoir, and undertake certain well and reservoir development operations, such as regulating the flow of production or engaging in EOR operations to optimize the production of the well.

SUMMARY

Applicants have recognized that traditional well development systems and methods suffer from various shortcomings. In some instances, traditional well monitoring and assessment relies on down-hole sensors disposed in a wellbore, such as bottom hole pressure sensors disposed deep in the wellbore or a well, at or near a subsurface reservoir, to determine a reservoir pressure for the well. Moreover, in many instances, such as in the case of high-pressure high temperature (HPHT) gas wells, down-hole sensors may not be deployed in the wellbores, eliminating the ability to directly sense and determine a reservoir pressure for the wells. As a result, it can be difficult to monitor and assess characteristics of wells, much less make informed decisions regarding appropriate development operations to optimize the production of the well.

Recognizing these and other shortcomings of existing systems and methods, Applicants have developed novel systems and methods of hydrocarbon production well monitoring, assessment and development. In some embodiments, reservoir characteristics are sensed at the surface of a hydrocarbon well, the reservoir characteristics are used to characterize a corresponding field of wells, and the field of wells is developed in accordance with the characterization. In some embodiments, surface characteristics of a well are defined by wellhead data obtained by way of sensors located at the surface, such as measurements of wellhead pressure, wellhead temperature, and wellhead production rate obtained by way of surface pressure sensors, surface temperature sensors and surface flow rate sensors, respectively, located at or near the wellhead of the well.

In some embodiments, trends in flowing wellhead pressure for a well are used to characterize performance of the well and a reservoir intersected by the well. The performance of the well and the reservoir can, in turn, be used to develop production strategies for the well and the reservoir, and development operations can be undertaken in accordance with the production strategies to optimize the overall production of the well and the reservoir. In some embodiments, characterizing the performance of a well or a reservoir includes characterizing changes in flowing wellhead pressure over periods of time in which a wellhead production rate for the well remains relatively constant. Applicants have recognized that changes in flowing wellhead pressure over periods of time in which the wellhead production rate is constant is devoid of frictional effects (e.g., frictional affects attributable to an interface of the production conduits, such as the walls of the wellbore, casing or production tubing) and effects fluid property changes of the production fluid. Applicants have also recognized that a flowing wellhead pressure of a well that is devoid of frictional effects and significant effects of property changes of the production fluid, corresponds directly to a reservoir pressure of the well, and, as a result, a change in the flowing wellhead pressure of the well over a period of time in which the wellhead production rate is constant corresponds to a change in the reservoir pressure of the well over the period of time. That is, the change in the reservoir pressure of the well over the period of time can be determined to be the same as the change in the flowing wellhead pressure of the well over the period of time. Such a technique enables characterization of a reservoir intersected by a well, including a depletion rate of the well that is indicative of a change in reservoir pressure per unit of volume of production.

In some embodiments, monitoring and assessment of a well includes the following: (1) obtaining wellhead production data for the well (e.g., including a measure of an initial reservoir pressure at a start of a period of interest, and measures of flowing wellhead pressure and measures of wellhead production rate for the well over the period of interest); (2) determining, based on the wellhead production data for the well, observed constant wellhead production rates for the well (e.g., including determining a subset of observed constant wellhead production rates for the well that each occur at least a threshold number of times (e.g., 10 times) over the period of interest); (4) for each of the observed constant wellhead production rates: (a) determining, based on the wellhead production data for the well, a corresponding wellhead pressure and a cumulative production volume for each occurrence of the observed wellhead production rate (e.g., including determining an average flowing wellhead pressure and a cumulative production volume for each occurrence of the observed wellhead production rate); (b) determining, based on the corresponding average wellhead pressures and cumulative production volumes for the observed constant wellhead production rate, a depletion rate for the observed constant wellhead production rate that is indicative of a change in flowing wellhead pressure of the well as a function of cumulative production volume of the well at the observed constant wellhead production rate (e.g., including determining a slope of a best fit line through points of wellhead pressure versus cumulative production volume for each occurrence of a constant wellhead production rate of the observed constant wellhead production rate); and (5) determining, based on the depletion rates for the observed constant wellhead production rates, a depletion rate for the well that is indicative of a change in a flowing wellhead pressure of the well as a function of production volume of the well (e.g., including averaging of the depletion rates for the observed constant wellhead production rates to arrive at the depletion rate for the well). In some embodiments, a cumulative production volume for the well over the period of interest is determined, a depletion of the well is determined by multiplying the depletion rate for the well by the cumulative production volume for the well over the period of interest, and a resulting reservoir pressure for the reservoir is determined by reducing the initial reservoir pressure by the depletion of the well. In some embodiments, well and reservoir development operations, such as throttling of production flow of the well or injection operations for the reservoir, are defined and conducted based on the depletion rate determined for the well.

Provided in some embodiments is a method of developing a hydrocarbon well. The method including: obtaining wellhead production data for a hydrocarbon well, the wellhead production data including: measurements of wellhead pressure of the hydrocarbon well over a period of interest; and measurements of wellhead production rate of the hydrocarbon well over the period of interest; determining, based on the measurements of wellhead production rate, observed constant wellhead production rates, each of the observed constant wellhead production rates including a constant wellhead production rate of the well that occurs at least a threshold number of times over the period of interest; determining, for each occurrence of a constant wellhead production rate of the observed constant wellhead production rates: a wellhead pressure for the occurrence of the constant wellhead production rate; and a cumulative production volume including a total production of the well at the occurrence of the constant wellhead production rate; determining, for each of the observed constant wellhead production rates, a depletion rate including a slope of a best fit line through points of wellhead pressure versus cumulative production volume for each occurrence of a constant wellhead production rate of the observed constant wellhead production rate, the depletion rate being indicative of a change in wellhead pressure of the well as a function of production volume of the well at the observed constant wellhead production rate; determining a depletion rate for the well including an average of the depletion rates for the observed constant wellhead production rates, the depletion rate for the well being indicative of a change in a wellhead pressure of the well as a function of production volume of the well; and adjusting, based on the depletion rate for the well, a production flow of the well.

In some embodiments, the method further includes: determining a cumulative production volume for the period of interest; determining a depletion of the well by multiplying the depletion rate for the well by the cumulative production volume for the period of interest; determining an initial reservoir pressure for a reservoir intersected by a wellbore of the well; and determining a resulting reservoir pressure for the reservoir by reducing the initial reservoir pressure by the depletion of the well. In certain embodiments, the measurements of wellhead pressure of the hydrocarbon well are obtained by way of a surface pressure sensor, and are measures of a flowing pressure of production flowing through a surface system of the well. In some embodiments, the measurements of wellhead production rate of the hydrocarbon well are obtained by way of a surface flow rate sensor, and are measures of a rate of production flow through a surface system of the well. In certain embodiments, each of the constant wellhead production rates of the well includes a wellhead production rate of the well that is constant for at least a threshold duration of time. In some embodiments, the threshold duration of time is 20 hours, and threshold number of times is 10 occurrences. In certain embodiments, the wellhead pressure for an occurrence of a constant wellhead production rate of the observed constant wellhead production rates includes an average of measurements of wellhead pressure of the hydrocarbon well over a duration of the occurrence of the constant wellhead production rate. In some embodiments, adjusting production flow of the well includes operating a production valve of the well to achieve a target depletion rate for the well. In certain embodiments, the method further includes: determining that the depletion rate for the well is below a target depletion rate for the well; and conducting the injection operation in response to determining that the depletion rate for the well is below a target depletion rate for the well, to stimulate production at the well.

Provided in some embodiments is a hydrocarbon well system including: a surface sensing system including: a surface pressure sensor adapted to acquire measurements of wellhead pressure of a hydrocarbon well over a period of interest; a surface flow rate sensors adapted to acquire measurements of wellhead production rate of the hydrocarbon well over the period of interest; a well control system adapted to: obtain wellhead production data for the hydrocarbon well, the wellhead production data including: the measurements of wellhead pressure of the hydrocarbon well over the period of interest; and the measurements of wellhead production rate of the hydrocarbon well over the period of interest; determine, based on the measurements of wellhead production rate, observed constant wellhead production rates, each of the observed constant wellhead production rates including a constant wellhead production rate of the well that occurs at least a threshold number of times over the period of interest; determine, for each occurrence of a constant wellhead production rate of the observed constant wellhead production rates: a wellhead pressure for the occurrence of the constant wellhead production rate; and a cumulative production volume including a total production of the well at the occurrence of the constant wellhead production rate; determine, for each of the observed constant wellhead production rates, a depletion rate including a slope of a best fit line through points of wellhead pressure versus cumulative production volume for each occurrence of a constant wellhead production rate of the observed constant wellhead production rate, the depletion rate being indicative of a change in wellhead pressure of the well as a function of production volume of the well at the observed constant wellhead production rate; determine a depletion rate for the well including an average of the depletion rates for the observed constant wellhead production rates, the depletion rate for the well being indicative of a change in a wellhead pressure of the well as a function of production volume of the well; and adjust, based on the depletion rate for the well, a production flow of the well.

In some embodiments, the well control system is further adapted to: determine a cumulative production volume for the period of interest; determine a depletion of the well by multiplying the depletion rate for the well by the cumulative production volume for the period of interest; determine an initial reservoir pressure for a reservoir intersected by a wellbore of the well; and determine a resulting reservoir pressure for the reservoir by reducing the initial reservoir pressure by the depletion of the well. In certain embodiments, the measurements of wellhead pressure of the hydrocarbon well are measures of a flowing pressure of production flowing through a surface system of the well. In some embodiments, the measurements of wellhead production rate of the hydrocarbon well are measures of a rate of production flow through a surface system of the well. In certain embodiments, each of the constant wellhead production rates of the well includes a wellhead production rate of the well that is constant for at least a threshold duration of time. In some embodiments, the threshold duration of time is 20 hours, and threshold number of times is 10 occurrences. In some embodiments, the wellhead pressure for an occurrence of a constant wellhead production rate of the observed constant wellhead production rates includes an average of measurements of wellhead pressure of the hydrocarbon well over a duration of the occurrence of the constant wellhead production rate. In certain embodiments, adjusting production flow of the well includes operating a production valve of the well to achieve a target depletion rate for the well. In some embodiments, the well control system is further adapted to: determine whether the depletion rate for the well is below a target depletion rate for the well; and conduct an injection operation in response to determining that the depletion rate for the well is below a target depletion rate for the well, to stimulate production at the well.

Provided in some embodiments is a non-transitory medium including program instructions stored thereon that are executable by a processor to cause the following operations: obtaining wellhead production data for a hydrocarbon well, the wellhead production data including: measurements of wellhead pressure of the hydrocarbon well over a period of interest; and measurements of wellhead production rate of the hydrocarbon well over the period of interest; determining, based on the measurements of wellhead production rate, observed constant wellhead production rates, each of the observed constant wellhead production rates including a constant wellhead production rate of the well that occurs at least a threshold number of times over the period of interest; determining, for each occurrence of a constant wellhead production rate of the observed constant wellhead production rates: a wellhead pressure for the occurrence of the constant wellhead production rate; and a cumulative production volume including a total production of the well at the occurrence of the constant wellhead production rate; determining, for each of the observed constant wellhead production rates, a depletion rate including a slope of a best fit line through points of wellhead pressure versus cumulative production volume for each occurrence of a constant wellhead production rate of the observed constant wellhead production rate, the depletion rate being indicative of a change in wellhead pressure of the well as a function of production volume of the well at the observed constant wellhead production rate; determining a depletion rate for the well including an average of the depletion rates for the observed constant wellhead production rates, the depletion rate for the well being indicative of a change in a wellhead pressure of the well as a function of production volume of the well; and adjusting, based on the depletion rate for the well, a production flow of the well. In some embodiments, the measurements of wellhead pressure of the hydrocarbon well are obtained by way of a surface pressure sensor, and are measures of a flowing pressure of production flowing through a surface system of the well.

BRIEF DESCRIPTION OF THE DRAWINGS

FIGS. 3A-3E are tables that illustrate example wellhead data and characterizations of a well in accordance with one or more embodiments.

Figure 1:
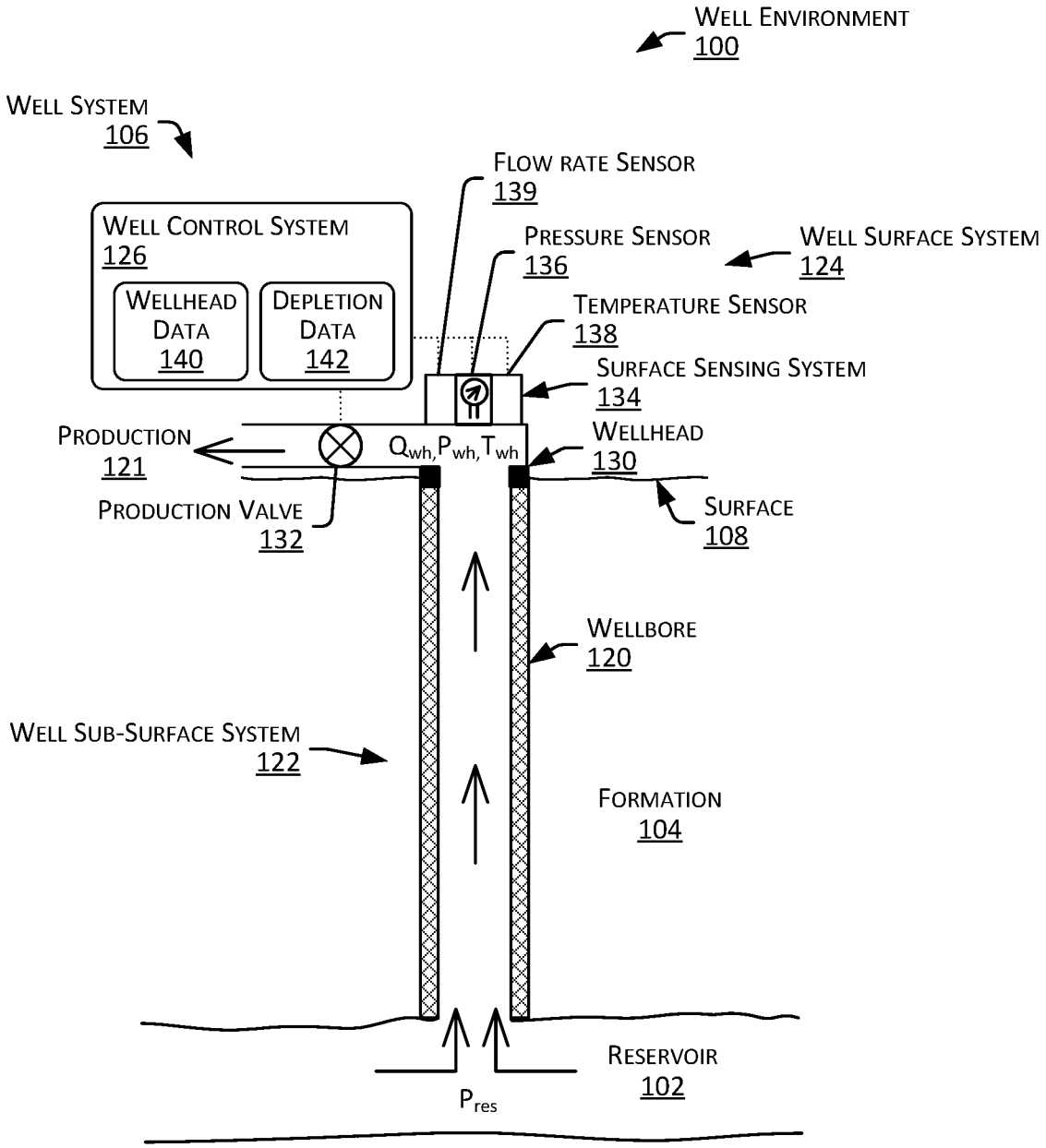
FIG. 1 is a diagram that illustrates a well environment in accordance with one or more embodiments.

While this disclosure is susceptible to various modifications and alternative forms, specific embodiments are shown by way of example in the drawings and will be described in detail. The drawings may not be to scale. It should be understood that the drawings and the detailed descriptions are not intended to limit the disclosure to the particular form disclosed, but are intended to disclose modifications, equivalents, and alternatives falling within the spirit and scope of the present disclosure as defined by the claims.

DETAILED DESCRIPTION

Described are embodiments of systems and methods of hydrocarbon production well monitoring, assessment and development. In some embodiments, reservoir characteristics are sensed at the surface of a hydrocarbon well, the reservoir characteristics are used to characterize a corresponding field of wells, and the field of wells is developed in accordance with the characterization. In some embodiments, surface characteristics of a well are defined by wellhead data obtained by way of sensors located at the surface, such as measurements of wellhead pressure, wellhead temperature, and wellhead production rate obtained by way of surface pressure sensors, surface temperature sensors and surface flow rate sensors, respectively, located at or near the wellhead of the well.

In some embodiments, trends in flowing wellhead pressure for a well are used to characterize performance of the well and a reservoir intersected by the well. The performance of the well and the reservoir can, in turn, be used to develop production strategies for the well and the reservoir, and well development operations can be undertaken in accordance with the production strategies to optimize the overall production of the well and the reservoir. In some embodiments, characterizing the performance of a well or a reservoir includes characterizing changes in flowing wellhead pressure over periods of time in which a wellhead production rate for the well remains relatively constant.

In some embodiments, monitoring and assessment of a well includes the following: (1) obtaining wellhead production data for the well (e.g., including a measure of an initial reservoir pressure ($P_{res}$) a start of a period of interest, and measures of flowing wellhead pressure and measures of wellhead production rate for the well over the period of interest); (2) determining, based on the wellhead production data for the well, observed constant wellhead production rates for the well (e.g., including determining a subset of observed constant wellhead production rates for the well that each occur at least a threshold number of times (e.g., 10 times) over the period of interest); (4) for each of the observed constant wellhead production rates: (a) determining, based on the wellhead production data for the well, a corresponding wellhead pressure and a cumulative production volume for each occurrence of the observed wellhead production rate (e.g., including determining an average flowing wellhead pressure and a cumulative production volume for each occurrence of the observed wellhead production rate); (b) determining, based on the corresponding average wellhead pressures and cumulative production volumes for the observed constant wellhead production rate, a depletion rate for the observed constant wellhead production rate that is indicative of a change in flowing wellhead pressure of the well as a function of cumulative production volume of the well at the observed constant wellhead production rate (e.g., including determining a slope of a best fit line through points of wellhead pressure versus cumulative production volume for each occurrence of a constant wellhead production rate of the observed constant wellhead production rate); and (5) determining, based on the depletion rates for the observed constant wellhead production rates, a depletion rate for the well that is indicative of a change in a flowing wellhead pressure of the well as a function of production volume of the well (e.g., including averaging of the depletion rates for the observed constant wellhead production rates to arrive at the depletion rate for the well). In some embodiments, a cumulative production volume for the well over the period of interest is determined, a depletion of the well is determined by multiplying the depletion rate for the well by the cumulative production volume for the well over the period of interest, and a resulting reservoir pressure for the reservoir is determined by reducing the initial reservoir pressure by the depletion of the well. In some embodiments, well and reservoir development operations, such as throttling of production flow of the well or injection operations for the reservoir, are defined and conducted based on the depletion rate determined for the well.

FIG. 1 is diagram that illustrates a well environment 100 in accordance with one or more embodiments. In the illustrated embodiment, the well environment 100 includes a hydrocarbon reservoir ("reservoir") 102 located in a subsurface formation ("formation") 104 and a well system ("well") 106.

The formation 104 may include a porous or fractured rock formation that resides underground, beneath the earth's surface ("surface") 108. In the case of the well 106 being a hydrocarbon well, the reservoir 102 may include a portion of the formation 104 that contains (or that is at least determined to or expected to contain) a subsurface pool of hydrocarbons, such as oil and gas. The formation 104 and the reservoir 102 may each include different layers of rock having varying characteristics, such as varying degrees of permeability, porosity, and resistivity. In the case of the well 106 being operated as a production well, the well 106 may facilitate the extraction of hydrocarbons (or "production") from the reservoir 102. In the case of the well 106 being operated as an injection well, the well 106 may facilitate the injection of substances, such as water, into the reservoir 102. In the case of the well 106 being operated as a monitoring well, the well 106 may facilitate the monitoring of characteristics of the reservoir 102, such as reservoir pressure or water encroachment.

In some embodiments, the well 106 includes a hydrocarbon production well for extracting hydrocarbons, such as oil and gas, from the reservoir 102. The well 106 may include, for example, a high-pressure high temperature (HPHT) gas well for extracting HPHT natural gas from the reservoir 102. The well 106 may include a wellbore 120, a well subsurface system 122, a well surface system 124, and a well control system ("control system") 126. The control system 126 may control various operations of the well 106, such as well drilling operations, well completion operations, well production operations, and well and reservoir monitoring, assessment and development operations. In some embodiments, the control system 126 includes a computer system that is the same as or similar to that of computer system 1000 described with regard to at least FIG. 4.

The wellbore 120 may include a bored hole that extends from the surface 108 into a target zone of the formation 104, such as the reservoir 102. An upper end of the wellbore 120, terminating at or near the surface 108, may be referred to as the "up-hole" end of the wellbore 120, and a lower end of the wellbore, terminating in the formation 104, may be referred to as the "down-hole" end of the wellbore 120. The wellbore 120 may be created, for example, by a drill bit boring through the formation 104 and the reservoir 102. The wellbore 120 may facilitate the circulation of drilling fluids during drilling operations, the flow of production 121 (e.g., oil and gas) from the reservoir 102 to the surface 108 during production operations, the injection of substances (e.g., water) into the formation 104 or the reservoir 102 during injection operations, or the communication of monitoring devices (e.g., logging tools) into the formation 104 or the reservoir 102 during monitoring operations (e.g., during in situ logging operations).

In some embodiments, the well subsurface system 122 includes casing installed in the wellbore 120. For example the wellbore 120 may have a cased portion and an uncased (or "open-hole") portion. The cased portion may include a portion of the wellbore having casing (e.g., casing pipe and casing cement) disposed therein. The uncased portion may include a portion of the wellbore not having casing disposed therein. In some embodiments, the casing includes an annular casing that lines the wall of the wellbore 120 to define a central passage that provides a conduit for the transport of tools and substances through the wellbore 120. For example, the central passage may provide a conduit for lowering logging tools into the wellbore 120, a conduit for the flow of production 121 (e.g., oil and gas) from the reservoir 102 to the surface 108, or a conduit for the flow of injection substances (e.g., water) from the surface 108 into the formation 104. In some embodiments, the well subsurface system 122 includes production tubing installed in the wellbore 120. The production tubing may provide a conduit for the transport of tools and substances through the wellbore 120. The production tubing may, for example, be disposed inside casing. In such an embodiment, the production tubing may provide a conduit for some or all of the production 121 (e.g., oil and gas) passing through the wellbore 120 and the casing.

In some embodiments, the well surface system 124 includes a wellhead 130. The wellhead 130 may include a rigid structure installed at the "up-hole" end of the wellbore 120, at or near where the wellbore 120 terminates at the Earth's surface 108. The wellhead 130 may include structures for supporting (or "hanging") casing and production tubing extending into the wellbore 120. Production 121 may flow through the wellhead 130, after exiting the wellbore 120 and the well subsurface system 122, including, for example, the casing and the production tubing. In some embodiments, the well surface system 124 includes flow regulating devices that are operable to control the flow of substances into and out of the wellbore 120. For example, the well surface system 124 may include one or more production valves 132 that are operable to control the flow of production 134. For example, a production valve 132 may be fully opened to enable unrestricted flow of production 121 from the wellbore 120, the production valve 132 may be partially opened to partially restrict (or "throttle") the flow of production 121 from the wellbore 120, and production valve 132 may be fully closed to fully restrict (or "block") the flow of production 121 from the wellbore 120, and through the well surface system 124.

In some embodiments, the well surface system 124 includes a surface sensing system 134. The surface sensing system 134 may include sensors for sensing characteristics of substances, including production 121, passing through or otherwise located in the well surface system 124. The characteristics may include, for example, pressure, temperature and flow rate of production 121 flowing through the wellhead 130, or other conduits of the well surface system 124, after exiting the wellbore 120.

In some embodiments, the surface sensing system 134 includes a surface pressure sensor 136 operable to sense the pressure of production 151 flowing through the well surface system 124, after it exits the wellbore 120. The surface pressure sensor 136 may include, for example, a "wellhead pressure sensor" that senses a pressure of production 121 flowing through or otherwise located in the wellhead 130, referred to as "wellhead pressure" (NO. The sensed pressure of production 121 as it flows through the wellhead 130 may be referred to as "flowing" wellhead pressure.

In some embodiments, the surface sensing system 134 includes a surface temperature sensor 138 operable to sense the temperature of production 151 flowing through the well surface system 124, after it exits the wellbore 120. The surface temperature sensor 138 may include, for example, a "wellhead temperature sensor" that senses a temperature of production 121 flowing through or otherwise located in the wellhead 130, referred to as "wellhead temperature" ($T_{wh}$). The sensed temperature of production 121 as it flows through the wellhead 130 may be referred to as "flowing" wellhead temperature.

In some embodiments, the surface sensing system 134 includes a surface flow rate sensor 139 operable to sense the flow rate of production 151 flowing through the well surface system 124, after it exits the wellbore 120. The surface flow sensor 139 may include, for example, a "wellhead flow rate sensor" that senses a flow rate of production 121 passing through the wellhead 130, referred to as a "wellhead production rate" or "well production rate" ($Q_{wh}$). The volume and flow rate of production 121 passing through the wellhead 130 may be the same as the volume and flow rate production 121 flowing through the well surface system 124, and that is ultimately produced by the well 106.

In some embodiments, during operation of the well 106, the control system 126 collects and records wellhead data 140 for the well 106. The wellhead data 140 may include, for example, a record of measurements of wellhead pressure ($P_{wh}$) (e.g., including flowing wellhead pressure), wellhead temperature ($T_{wh}$) (e.g., including flowing wellhead temperature), and wellhead production rate ($Q_{wh}$) over some or all of the life of the well 106. For example, for a well 106 that begins to produce on Jul. 7, 2015, wellhead data 140 for the first month-and-a-half of the life of the well 106 may include measurements of flowing wellhead pressure, flowing wellhead temperature, and wellhead production rate over the time period of Jul. 7, 2015 through Aug. 21, 2015. This may include, for example, respective datasets of flowing wellhead pressure ($P_{wh}$), flowing wellhead temperature ($T_{wh}$), and wellhead production rate ($Q_{wh}$) acquired at regular intervals over the time period (e.g., ($P_{wh1}$, $T_{wh1}$, $Q_{wh1}$) acquired at 12:01 am on Jul. 7, 2015, ($P_{wh2}$, $T_{wh2}$, $Q_{wh2}$) acquired at 12:02 am on Jul. 7, 2015, and so forth). In some embodiments, the measurements are recorded in real-time, and are available for review or use within seconds, minutes or hours of the condition being sensed (e.g., the measurements are available within 1 hour of the condition being sensed). In such an embodiment, the wellhead data 140 may be referred to as "real-time" wellhead data 140. Real-time wellhead data 140 may enable an operator of the well 106 to assess a relatively current state of the well 106, and make real-time decisions regarding development of the well 106 and the reservoir 102, such as on-demand adjustments in regulation of production flow from the well and on-demand adjustments of injection operations in the reservoir 102, shortly after relevant conditions are sensed.

In some embodiments, trends in flowing wellhead pressure for the well 106 are used to characterize performance of the well 106 and the reservoir 102. The performance of the well 106 and the reservoir 102 can, in turn, be used to develop production strategies for the well 106 and the reservoir 102, and well and reservoir development operations can be undertaken in accordance with the production strategies to optimize overall production of the well 106 and the reservoir 102. In some embodiments, characterizing the performance of the well 106 or the reservoir 102 includes characterizing changes in flowing wellhead pressure for the well 106 over periods of time in which a wellhead production rate for the well 106 remains constant. A wellhead production rate for the well 106 for a given duration of time (e.g., for a 24 hour period) may be defined as constant, if it is determined that the measured wellhead production rates for the well 106 over the duration of time remain within a given rate tolerance (maximum of 1%) of the wellhead production rate determined for the duration of time. For example, if an hourly rate tolerance is 1% for the well 106, an average wellhead production rate for the well 106 is determined to be 10 million standard cubic feet per day (MMSCFD) for a given day, and the actual measured wellhead production rates for the well 106 did not drop below 9.9 MMSCFD or exceed 10.1 MMSCFD during that given day, then average wellhead production rate of 10 MMSCFD may be considered to represent a constant wellhead production rate for the well 106 for that 24 hour period.

In some embodiments, characterization of the well 106 includes the following: (1) obtaining wellhead production data 140 for the well 106 (e.g., including a measure of an initial reservoir pressure at a start of a period of interest, and measures of flowing wellhead pressure and measures of wellhead production rate for the well 106 over the period of interest); (2) determining, based on the wellhead production data 140 for the well 106, observed constant wellhead production rates for the well 106 (e.g., including determining a subset of observed constant wellhead production rates for the well 106 that each occur at least a threshold number of times (e.g., 10 times) over the period of interest); (4) for each of the observed constant wellhead production rates: (a) determining, based on the wellhead production data 140 for the well 106, a corresponding wellhead pressure and a cumulative production volume for each occurrence of the observed wellhead production rate (e.g., including determining an average flowing wellhead pressure and a cumulative production volume for each occurrence of the observed wellhead production rate); (b) determining, based on the corresponding average wellhead pressures and cumulative production volumes for the observed constant wellhead production rate, a depletion rate for the observed constant wellhead production rate that is indicative of a change in flowing wellhead pressure of the well 106 as a function of cumulative production volume of the well 106 at the observed constant wellhead production rate (e.g., including determining a slope of a best fit line through points of wellhead pressure versus cumulative production volume for each occurrence of a constant wellhead production rate of the observed constant wellhead production rate); and (5) determining, based on the depletion rates for the observed constant wellhead production rates, a depletion rate for the well 106 that is indicative of a change in a flowing wellhead pressure of the well 106 as a function of production volume of the well 106 (e.g., including averaging of the depletion rates for the observed constant wellhead production rates to arrive at the depletion rate for the well 106).

In some embodiments, a cumulative production volume for the well 106 over the period of interest is determined, a depletion of the well 106 is determined by multiplying the depletion rate for the well 106 by the cumulative production volume for the well 106 over the period of interest, and a resulting reservoir pressure for the reservoir 102 is determined by reducing the initial reservoir pressure by the depletion of the well. The depletion rate for the well 106, and the resulting reservoir pressure for the reservoir 102 may, for example, be stored in the depletion data 142 in a memory of the control system 126. In some embodiments, well and reservoir development operations, such as throttling of production flow of a well 106 or injection operations for the reservoir 106, are defined and conducted based on the depletion data 142, such as the depletion rate determined for the well 106.

Figure 2:
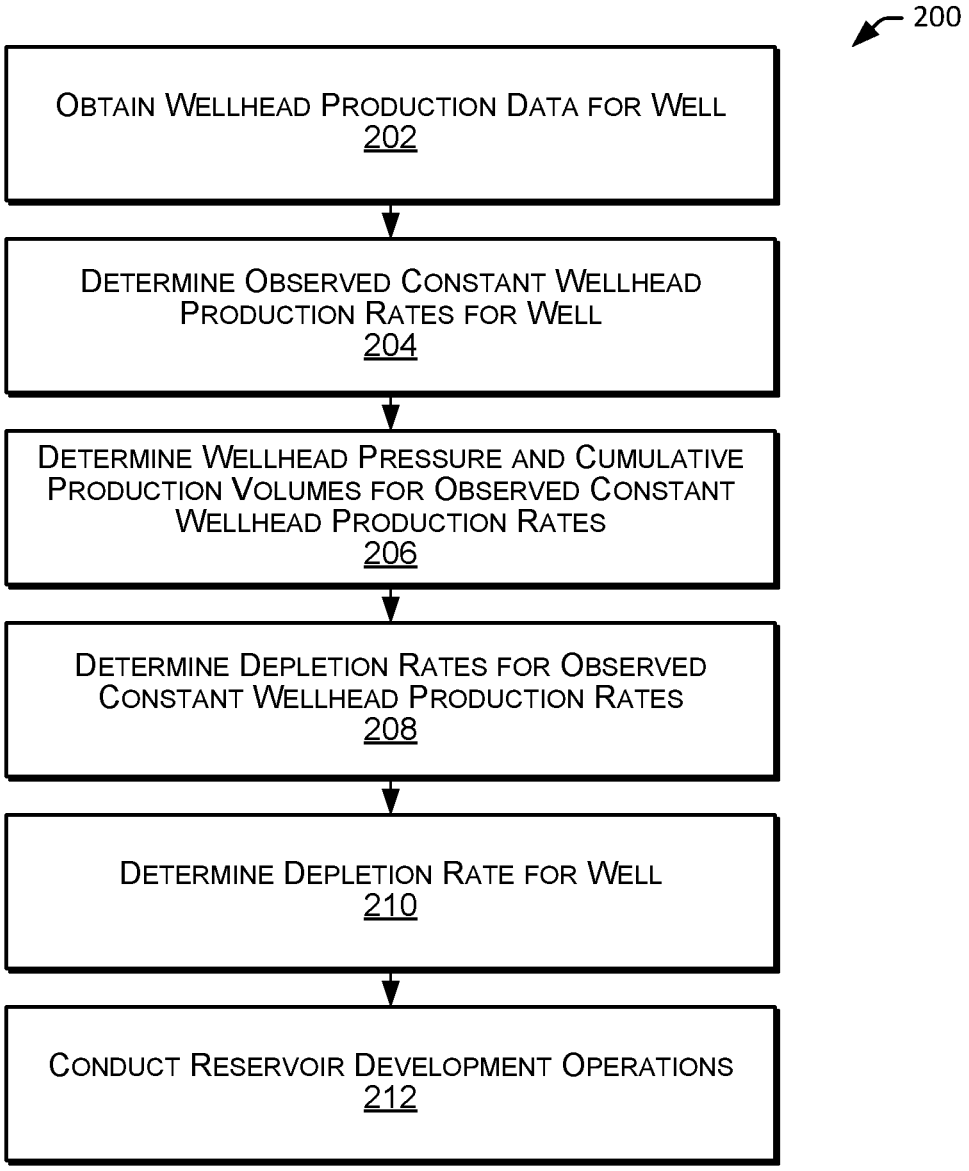
FIG. 2 is a flowchart diagram that illustrates a method of developing a hydrocarbon production well in accordance with one or more embodiments.

FIG. 2 is a flowchart diagram that illustrates a method 200 of developing a hydrocarbon production well in accordance with one or more embodiments. Method 200 generally includes obtaining wellhead production data for the well (block 202), determining observed constant wellhead production rates for the well (block 204), determining corresponding wellhead pressures and cumulative production volumes for the observed constant wellhead production rates for the well (block 206), determining depletion rates for the observed constant wellhead production rates for the well (block 208), determining a depletion rate for the well (block 210), and conducting reservoir development operations (block 212).

In some embodiments, obtaining wellhead production data for the well (block 202) includes obtaining wellhead production data 140 for the well 106. This may include obtaining a measure of an initial reservoir pressure at a start of a period of interest, and measures of flowing wellhead pressure and measures of wellhead production rate for the well 106 over the period of interest. For example, if a period of interest for the well 106 ("Well-A") extending into the reservoir 102, is from Jul. 7, 2015 to Aug. 21, 2015, obtaining wellhead production data for the well 106 may include acquiring wellhead data 140 for the well 106, including obtaining measurements of flowing wellhead pressure ($P_{wh}$) by way of the surface pressure sensor 136 of the well 106, obtaining measurements of flowing wellhead temperature ($T_{wh}$) by way of the surface temperature sensor 138 of the well 106, and obtaining measurements of wellhead production rate ($Q_{wh}$) by way of the surface flow sensor 139 of the well 106, over the time period of 12:00 am, Jul. 7, 2015 to 12:00 am, Aug. 22, 2015.

In some embodiments, an initial reservoir pressure at a start of a period of interest is a shut-in wellhead pressure (or down-hole pressure) measured before the start of the period of interest. Continuing with the previous example, obtaining the initial reservoir pressure for the well 102 may include closing the production valve 132 at 12:00 pm on Jul. 6, 2015 (to inhibit the flow of production 121 from the well 106 and allow the fluid pressure in the wellbore 120 and at the wellhead 130 to stabilize) and, in response to determining that the fluid pressure in the wellbore 120 and at the wellhead 130 has stabilized, obtaining a measurement of wellhead pressure by way of the surface pressure sensor 136 of the well 106 (or obtaining a measurement of down-hole pressure by way of a down-hole pressure sensor 136 of the well 106 located at depth in the wellbore 120 corresponding to the depth of the reservoir 102) at 11:59 pm am on Jul. 6, 2015, while the production valve 132 remains closed, and shortly before opening the production valve 132 at 12:00 am on Jul. 7, 2017 to enable the flow of production 121 from the well 106, and using that measured wellhead pressure and the known depth of the reservoir 102 (or down-hole pressure) the to determine an initial reservoir pressure of 6000 pounds per square inch (psi).

In some embodiments, the well 106 is operated to maintain a constant flow rate over extended durations of time. For example, the well 106 may be operated to maintain a constant flow rate of production 121 over 24 hour increments. Continuing with the previous example, the well control system 126 may operate the production valve 132 of the well 106 to control the wellhead flow rate of production 121 at or near 10 MMSCFD from 12:00 am, Jul. 7, 2015 to 12:00 am, Jul. 8, 2017, to control the wellhead flow rate of production 121 at or near 15 MMSCFD from 12:00 am, Jul. 8, 2015 to 12:00 am, Jul. 9, 2017, and so forth.

In some embodiments, determining observed constant wellhead production rates for the well (block 204) includes determining, based on the wellhead production data 140 for the well 106, a subset of observed constant wellhead production rates for the well 106 that each occur at least a threshold number of times (e.g., 10 times) over the period of interest. A wellhead production rate for the well 106 for a given duration of time (e.g., for a 24 hour period) may be defined as constant, for example, if it is determined that the measured wellhead production rates for the well 106 over the duration of time remain within a given rate tolerance (e.g., within 1%) of the wellhead production rate determined for the duration of time. That is, a wellhead production rate of the well 106 that remains constant for at least a threshold duration of time may be defined as an observed constant wellhead production rate for the well 106. For example, if a daily rate tolerance is 1% for the well 106, an average wellhead production rate for the well 106 is determined to be 10 MMSCFD for a given day, and the actual measured wellhead production rates for the well 106 did not drop below 9.9 MMSCFD or exceed 10.1 MMSCFD during that given day, then average wellhead production rate of 10 MMSCFD may be considered to represent a constant wellhead production rate for the well 106 for that given day. The subset of constant wellhead production rates may only include constant wellhead production rates that occur at least a threshold number of times (e.g., at least 10 times) over the period of interest. Continuing with the previous example, if the threshold number of occurrences is set to 10 occurrences for the time period of 12:00 am, Jul. 7, 2015 to 12:00 am, Aug. 22, 2015 and the well 106 is determined to have an observed constant wellhead production rate of 10 MMSCFD for 15 days over the time period, an observed constant wellhead production rate of 15 MMSCFD for 15 days over the time period, an observed constant wellhead production rate of 20 MMSCFD for 15 days over the time period, and an observed constant wellhead production rate of 5 MMSCFD for 1 day over the time period, then the subset of observed constant wellhead production rates for the well 106 may include the observed constant wellhead production rates of 10, 15 and 20 MMSCFD, and may not include the observed constant wellhead production rate of 5 MMSCFD.

In some embodiments, determining corresponding wellhead pressures and cumulative production volumes for the observed constant wellhead production rates for the well (block 206) includes, for each of the observed constant wellhead production rates, determining, based on the wellhead production data 140 for the well 106, an average flowing wellhead pressure and a cumulative production volume for each occurrence of the observed wellhead production rate. Continuing with the previous example, if the observed constant wellhead production rate of 10 MMSCFD occurs 15 days over the time period, the observed constant wellhead production rate of 15 MMSCFD occurs 15 days over the time period, and the observed constant wellhead production rate of 20 MMSCFD occurs 15 days over the time period, then an average wellhead pressure and a cumulative production volume may be determined for each of the 45 days.

The average wellhead pressure for an occurrence of an observed constant wellhead production rate may include an average of the measurements of flowing wellhead pressure ($P_{wh}$) for the well 106 over the duration of the occurrence. Continuing with the previous example, if an observed constant wellhead production rate of 10 MMSCFD on Jul. 7, 2015 is based on flowing wellhead pressure determined to be constant from 12:00 am, Jul. 7, 2015 to 12:00 am, Jul. 8, 2015, an average wellhead pressure (e.g., an average wellhead pressure of 5000 psi) for the occurrence of the observed constant wellhead production rate of 10 MMSCFD on Jul. 7, 2015 may be the average of the measurements of flowing wellhead pressure ($P_{wh}$) for the well 106 from 12:00 am, Jul. 7, 2015 to 12:00 am, Jul. 8, 2015.

The cumulative production volume for an occurrence of an observed constant wellhead production rate may include a total production of the well 106 at the conclusion of the occurrence. Continuing with the previous example, if an observed constant wellhead production rate of 10 MMSCFD on Jul. 7, 2015 is based on flowing wellhead pressure determined to be constant from 12:00 am, Jul. 7, 2015 to 12:00 am, Jul. 8, 2015, a cumulative production volume for the occurrence of the observed constant wellhead production rate of 10 MMSCFD on Jul. 7, 2015 may be the total production of the well 106 up to 12:00 am, Jul. 8, 2015 (e.g., a cumulative production volume of 10 MMSCF).

FIG. 3A is a table that illustrates example wellhead production data 300 for a well 106 ("Well-A") in accordance with one or more embodiments. The constant production data 300 includes different observed constant wellhead production rates of 5, 10, 15 and 20 MMSCFD for Jul. 7, 2015 through Aug. 21, 2017 (e.g., for the time period of 12:00 am, Jul. 7, 2015 to 12:00 am, Aug. 22, 2015), and corresponding average wellhead pressures and cumulative production volumes. Each of the values may be determined in accordance with the techniques described here.

In some embodiments, determining depletion rates for the observed constant wellhead production rates for the well (block 208) includes, for each observed constant wellhead production rate, determining, based on the corresponding average wellhead pressures and cumulative production volumes for the observed constant wellhead production rate, a depletion rate for the observed constant wellhead production rate that is indicative of a change in flowing wellhead pressure of the well 106 as a function of cumulative production volume of the well 106 at the observed constant wellhead production rate. This may include determining a slope of a best fit line through points of wellhead pressure versus cumulative production volume for each occurrence of a constant wellhead production rate of the observed constant wellhead production rate—the slope defining the depletion rate for the observed constant production rate. Continuing with the previous example, depletion rates of −1.04 psi/MMSCF, −1.29 psi/MMSCF and −1.33 psi/MMSCF may be determined for observed constant wellhead production rates of 10, 15 and 20 MMSCFD, respectively. FIGS. 3B, 3B and 3C are table that illustrates subsets of constant production data 302*a*, 302*b* and 302*c* and corresponding depletion rates of −1.04 psi/MMSCF, −1.29 psi/MMSCF and −1.33 psi/MMSCF determined for observed constant wellhead production rates of 10, 15 and 20 MMSCFD, respectively, in accordance with one or more embodiments. The depletion rate of −1.04 psi/MMSCF for the observed constant wellhead production rates of 10 MMSCFD may, for example, be determined by plotting the points of wellhead pressure versus cumulative production volume for each occurrence of the constant wellhead production rates of 10 MMSCFD (e.g., plotting the points (5000 psi, 10 MMSCF), (4950 psi, 55 MMSCF), . . . (4343.729064 psi, 640 MMSCF)), determining a best fit line for the plotted points, determining a slope of the best fit line as −1.041426453, and determining a corresponding depletion rate of −1.04 psi/MMSCF for the constant wellhead production rate of 10 MMSCF based on the slope. A similar assessment can be made to arrive at the depletion rates of −1.29 psi/MMSCF and −1.33 psi/MMSCF for the constant wellhead production rates of 15 and 20 MMSCFD, respectively.

In some embodiments, determining a depletion rate for the well (block 210) includes determining, based on the depletion rates for the observed constant wellhead production rates, a depletion rate for the well 106 that is indicative of a change in a flowing wellhead pressure of the well 106 as a function of production volume of the well 106. This may include determining an average of the depletion rates for the observed constant wellhead production rates to arrive at the depletion rate for the well 106. Continuing with the previous example, the depletion rates of −1.04 psi/MMSCF, −1.29 psi/MMSCF and −1.33 psi/MMSCF determined for observed constant wellhead production rates of 10, 15 and 20 MMSCFD, respectively, may be averaged to determine a depletion rate of −1.22 psi/MMSCF for the well 106. A well depletion, indicative of a drop in reservoir pressure at the well 106, may be determined as a product of the cumulative production at the end of the period of interest. For example, the depletion rate of −1.22 psi/MMSCF for the well 106 may be multiplied by the cumulative production of 680 MMSCF to determine a well depletion of −830 psi for the well 106. A resulting reservoir pressure for the well 106 may be determined by reducing the initial reservoir pressure by the well depletion. For example, the initial reservoir pressure of 6000 psi for the well 106 may be reduced by the well depletion of −830 psi for the well 106, to determine a resulting reservoir pressure of 5170 psi for the well 106. The resulting reservoir pressure may represent a reservoir pressure for the well 106, after the cumulative production of 680 MMSCF has been produced from the well 106. Well depletion analysis data, including, for example, the average/well depletion rate, the max depletion rate, the minimum depletion rate, the well depletion rate, the well depletion, and the resulting reservoir pressure may, for example, be stored in the depletion data 142 in a memory of the control system 126. FIG. 3E is a table that illustrates example well depletion analysis data 142 for Well-A in accordance with one or more embodiments.

In some embodiments, conducting reservoir development operations (block 212) includes conducting various operations for developing the well 106 and the reservoir 102 based on the depletion analysis data determined for the well 106. This may include determining and implementing throttling of production flow of the well 106 or conducting injection operations for the reservoir 106 based on the depletion rate determined for the well 106. For example, if a target well depletion of −10 psi/day is determined for the well 106 and depletion rate of −1.22 psi/MMSCF is determined for the well 106, the well control system 126 may operate the production valve 132 (e.g., partially open the production valve 132) such that the well 106 has a wellhead production rate of about 8.2 MMSCFD (e.g., 8.2 MMSCFD=−10 psi/day/−1.22 psi/MMSCF). As a further example, in response to determining that the actual depletion rate of −1.22 psi/MMSCF is lower than a target depletion rate of for the well 106 (e.g., a target depletion rate of −1 psi/MMSCF), the well control system 126 of the well 106 (or well control systems of nearby injection wells for the reservoir 102) may control operation of the nearby injection wells to increase injection rates, in an effort to maintain or slow the depletion of reservoir pressure at the well 106 as production 121 is extracted from the reservoir 102 by way of the well 106. Further, in response to determining that the actual depletion rate of −1.22 psi/MMSCF is higher than a target depletion rate of for the well 106 (e.g., a target depletion rate of −1.5 psi/MMSCF), the well control system 126 of the well 106 (or well control systems of nearby injection wells for the reservoir 102) may control operation of the nearby injection wells to reduce injection rates, in an effort to save costs associated with operating the injection wells. If a field of wells includes multiple wells drilled into the reservoir 102, the depletion data for the well 106 (and the other wells drilled into the reservoir 102) may provide an indication of well performance or variation of quality of the reservoir 102, across the field of wells. If the reservoir 102 is determined to be homogenous (e.g., having relatively constant characteristics across the extent of the field), wells with relatively low depletion rates (e.g., >−1.5 psi/MMSCF) may be considered to be operating optimally, and wells with relatively high depletions rates (e.g., <−1.5 psi/MMSCF) may be considered to be operating sub-optimally. In such an instance, the injection rates of injection wells in the field and the production rates of production wells in the field can be adjusted to reduce the depletion rates of the wells operating sub-optimally. The sub-optimal operation of a well may be caused, for example, by an additional pressure drop associated with features that cause the suboptimal well performance, such as wellbore skin. With regard to assessing quality of the reservoir 102, areas of the reservoir 102 with lower depletion rates (e.g., >−1.5 psi/MMSCF) may be determined to be of relatively high quality, whereas areas of the reservoir 102 with higher depletion rates (e.g., <−1.5 psi/MMSCF) may be determined to be of relatively low quality. The variations in quality may be caused, for example, by the varying amounts of energy required for moving fluids through the structure of the reservoir 102 (e.g., greater amounts of energy may be required to move fluids in relatively low quality sections of a reservoir).

Figure 4:
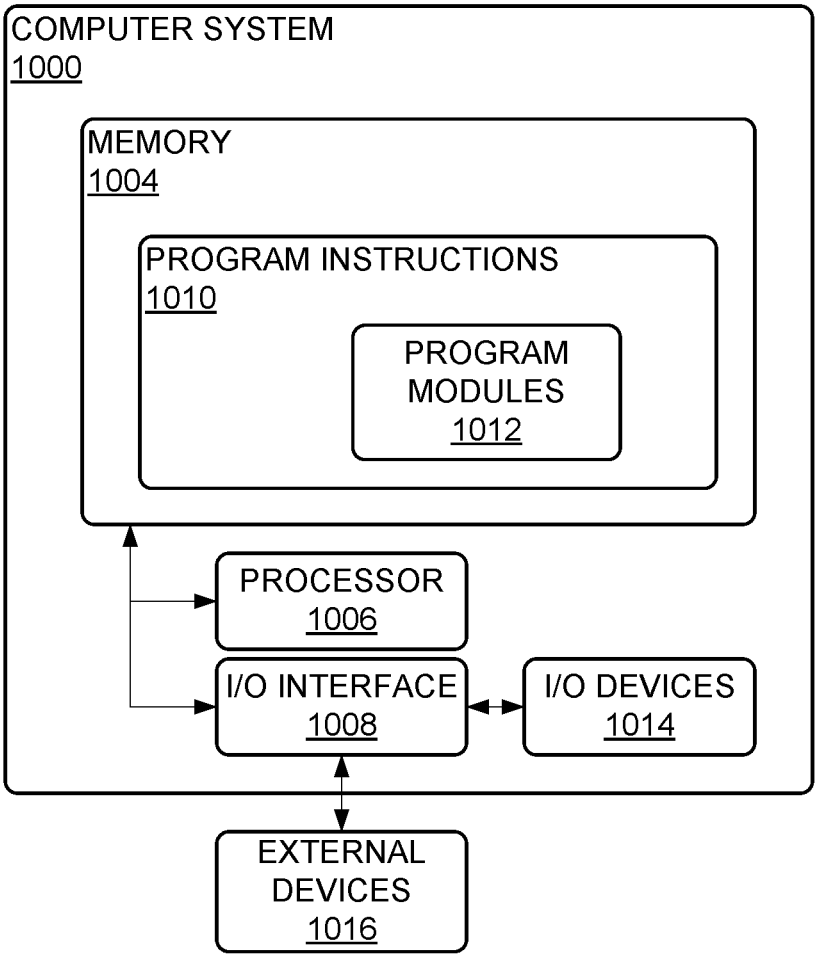
FIG. 4 is a diagram that illustrates an example computer system in accordance with one or more embodiments.

FIG. 4 is a diagram that illustrates an example computer system 1000 in accordance with one or more embodiments. In some embodiments, the system 1000 may be a programmable logic controller (PLC). The system 1000 may include a memory 1004, a processor 1006, and an input/output (I/O) interface 1008. The memory 1004 may include non-volatile memory (e.g., flash memory, read-only memory (ROM), programmable read-only memory (PROM), erasable programmable read-only memory (EPROM), electrically erasable programmable read-only memory (EEPROM)), volatile memory (e.g., random access memory (RAM), static random access memory (SRAM), synchronous dynamic RAM (SDRAM)), or bulk storage memory (e.g., CD-ROM or DVD-ROM, or hard drives). The memory 1004 may include a non-transitory computer-readable storage medium storing program instructions 1010. The program instructions 1010 may include program modules 1012 that are executable by a computer processor (e.g., the processor 1006) to cause the functional operations described here, such as those described with regard to the well control system 126 or the method 200.

The processor 1006 may be any suitable processor capable of executing program instructions. The processor 1006 may include a central processing unit (CPU) that carries out program instructions (e.g., the program instructions of the program module(s) 1012) to perform the arithmetical, logical, and input/output operations described here. The processor 1006 may include one or more processors. The I/O interface 1008 may provide an interface for communication with one or more I/O devices 1014, such as a joystick, a computer mouse, a keyboard, or a display screen (e.g., an electronic display for displaying a graphical user interface (GUI)). The I/O devices 1014 may be connected to the I/O interface 1008 by way of a wired (e.g., Industrial Ethernet) or a wireless (e.g., Wi-Fi) connection. The I/O interface 1008 may provide an interface for communication with one or more external devices 1016, such as other computers or networks. In some embodiments, the I/O interface 1008 include an antenna, or a transceiver. In some embodiments, the external devices 1016 include sensors (e.g., the surface pressure sensor 136, the surface temperature sensors 138, or the surface flow rate sensor 139) or control devices (e.g., the production valve 132).

Further modifications and alternative embodiments of various aspects of the disclosure will be apparent to those skilled in the art in view of this description. Accordingly, this description is to be construed as illustrative only and is for the purpose of teaching those skilled in the art the general manner of carrying out the embodiments. It is to be understood that the forms of the embodiments shown and described here are to be taken as examples of embodiments. Elements and materials may be substituted for those illustrated and described here, parts and processes may be reversed or omitted, and certain features of the embodiments may be utilized independently, all as would be apparent to one skilled in the art after having the benefit of this description of the embodiments. Changes may be made in the elements described here without departing from the spirit and scope of the embodiments as described in the following claims. Headings used here are for organizational purposes only and are not meant to be used to limit the scope of the description.

It will be appreciated that the processes and methods described here are example embodiments of processes and methods that may be employed in accordance with the techniques described. The processes and methods may be modified to facilitate variations of their implementation and use. The order of the processes and methods and the operations provided may be changed, and various elements may be added, reordered, combined, omitted, modified, etc. Portions of the processes and methods may be implemented in software, hardware, or a combination thereof. Some or all of the portions of the processes and methods may be implemented by one or more of the processors, modules, or applications described here.

As used throughout this application, the word "may" is used in a permissive sense (such as, meaning having the potential to), rather than the mandatory sense (such as, meaning must). The words "include," "including," and "includes" mean including, but not limited to. As used throughout this application, the singular forms "a", "an," and "the" include plural referents unless the content clearly indicates otherwise. Thus, for example, reference to "an element" may include a combination of two or more elements. As used throughout this application, the phrase "or" is used in an inclusive sense, unless indicated otherwise. That is, a description of an element including A or B may refer to the element including one or both of A and B. As used throughout this application, the phrase "based on" does not limit the associated operation to being solely based on a particular item. Thus, for example, processing "based on" data A may include processing based at least in part on data A and based at least in part on data B unless the content clearly indicates otherwise. As used throughout this application, the term "from" does not limit the associated operation to being directly from. Thus, for example, receiving an item "from" an entity may include receiving an item directly from the entity or indirectly from the entity (e.g., by way of an intermediary entity). Unless specifically stated otherwise, as apparent from the discussion, it is appreciated that throughout this specification discussions utilizing terms such as "processing," "computing," "calculating," or "determining," refer to actions or processes of a specific apparatus, such as a special purpose computer or a similar special purpose electronic processing/computing device. In the context of this specification, a special purpose computer or a similar special purpose electronic processing/computing device is capable of manipulating or transforming signals, typically represented as physical, electronic or magnetic quantities within memories, registers, or other information storage devices, transmission devices, or display devices of the special purpose computer or similar special purpose electronic processing/computing device.

What is claimed is:

1. A method of developing a hydrocarbon well, the method comprising:

obtaining wellhead production data for a hydrocarbon well, the wellhead production data comprising:

measurements of wellhead pressure of the hydrocarbon well over a period of interest; and measurements of wellhead production rate of the hydrocarbon well over the period of interest;

determining, based on the measurements of wellhead production rate, observed constant wellhead production rates, each of the observed constant wellhead production rates comprising a constant wellhead production rate of the well that occurs at least a threshold number of times over the period of interest;

determining, for each occurrence of a constant wellhead production rate of the observed constant wellhead production rates:

a wellhead pressure for the occurrence of the constant wellhead production rate; and a cumulative production volume comprising a total production of the well at the occurrence of the constant wellhead production rate;

determining, for each of the observed constant wellhead production rates, a depletion rate comprising a slope of a best fit line through points of wellhead pressure versus cumulative production volume for each occurrence of a constant wellhead production rate of the observed constant wellhead production rate, the depletion rate being indicative of a change in wellhead pressure of the well as a function of production volume of the well at the observed constant wellhead production rate;

determining a depletion rate for the well comprising an average of the depletion rates for the observed constant wellhead production rates, the depletion rate for the well being indicative of a change in a wellhead pressure of the well as a function of production volume of the well; and adjusting, based on the depletion rate for the well, a production flow of the well.

2. The method of claim 1, further comprising:

determining a cumulative production volume for the period of interest;

determining a depletion of the well by multiplying the depletion rate for the well by the cumulative production volume for the period of interest;

determining an initial reservoir pressure for a reservoir intersected by a wellbore of the well; and determining a resulting reservoir pressure for the reservoir by reducing the initial reservoir pressure by the depletion of the well.

3. The method of claim 1, wherein the measurements of wellhead pressure of the hydrocarbon well are obtained by way of a surface pressure sensor, and are measures of a flowing pressure of production flowing through a surface system of the well.

4. The method of claim 1, wherein the measurements of wellhead production rate of the hydrocarbon well are obtained by way of a surface flow rate sensor, and are measures of a rate of production flow through a surface system of the well.

5. The method of claim 1, wherein each of the constant wellhead production rates of the well comprises a wellhead production rate of the well that is constant for at least a threshold duration of time.

6. The method of claim 5, wherein the threshold duration of time is 20 hours, and threshold number of times is 10 occurrences.

7. The method of claim 1, wherein the wellhead pressure for an occurrence of a constant wellhead production rate of the observed constant wellhead production rates comprises an average of measurements of wellhead pressure of the hydrocarbon well over a duration of the occurrence of the constant wellhead production rate.

8. The method of claim 1, wherein adjusting production flow of the well comprises operating a production valve of the well to achieve a target depletion rate for the well.

9. The method of claim 1, further comprising:

determining that the depletion rate for the well is below a target depletion rate for the well; and conducting the injection operation in response to determining that the depletion rate for the well is below a target depletion rate for the well, to stimulate production at the well.

10. A hydrocarbon well system comprising:

a surface sensing system comprising:

a surface pressure sensor configured to acquire measurements of wellhead pressure of a hydrocarbon well over a period of interest;

a surface flow rate sensors configured to acquire measurements of wellhead production rate of the hydrocarbon well over the period of interest;

a well control system configured to:

obtain wellhead production data for the hydrocarbon well, the wellhead production data comprising:

the measurements of wellhead pressure of the hydrocarbon well over the period of interest; and the measurements of wellhead production rate of the hydrocarbon well over the period of interest;

determine, based on the measurements of wellhead production rate, observed constant wellhead production rates, each of the observed constant wellhead production rates comprising a constant wellhead production rate of the well that occurs at least a threshold number of times over the period of interest;

determine, for each occurrence of a constant wellhead production rate of the observed constant wellhead production rates:

a wellhead pressure for the occurrence of the constant wellhead production rate; and a cumulative production volume comprising a total production of the well at the occurrence of the constant wellhead production rate;

determine, for each of the observed constant wellhead production rates, a depletion rate comprising a slope of a best fit line through points of wellhead pressure versus cumulative production volume for each occurrence of a constant wellhead production rate of the observed constant wellhead production rate, the depletion rate being indicative of a change in wellhead pressure of the well as a function of production volume of the well at the observed constant wellhead production rate;

determine a depletion rate for the well comprising an average of the depletion rates for the observed constant wellhead production rates, the depletion rate for the well being indicative of a change in a wellhead pressure of the well as a function of production volume of the well; and adjust, based on the depletion rate for the well, a production flow of the well.

11. The system of claim 10, wherein the well control system is further configured to:

determine a cumulative production volume for the period of interest;

determine a depletion of the well by multiplying the depletion rate for the well by the cumulative production volume for the period of interest;

determine an initial reservoir pressure for a reservoir intersected by a wellbore of the well; and determine a resulting reservoir pressure for the reservoir by reducing the initial reservoir pressure by the depletion of the well.

12. The system of claim 10, wherein the measurements of wellhead pressure of the hydrocarbon well are measures of a flowing pressure of production flowing through a surface system of the well.

13. The system of claim 10, wherein the measurements of wellhead production rate of the hydrocarbon well are measures of a rate of production flow through a surface system of the well.

14. The system of claim 10, wherein each of the constant wellhead production rates of the well comprises a wellhead production rate of the well that is constant for at least a threshold duration of time.

15. The system of claim 14, wherein the threshold duration of time is 20 hours, and threshold number of times is 10 occurrences.

16. The system of claim 10, wherein the wellhead pressure for an occurrence of a constant wellhead production rate of the observed constant wellhead production rates comprises an average of measurements of wellhead pressure of the hydrocarbon well over a duration of the occurrence of the constant wellhead production rate.

17. The system of claim 10, wherein adjusting production flow of the well comprises operating a production valve of the well to achieve a target depletion rate for the well.

18. The system of claim 10, wherein the well control system is further configured to:

determine whether the depletion rate for the well is below a target depletion rate for the well; and conduct an injection operation in response to determining that the depletion rate for the well is below a target depletion rate for the well, to stimulate production at the well.

19. A method comprising using a non-transitory medium comprising program instructions stored thereon that are executable by a processor to cause the following operations:

obtaining wellhead production data for a hydrocarbon well, the wellhead production data comprising:

measurements of wellhead pressure of the hydrocarbon well over a period of interest; and measurements of wellhead production rate of the hydrocarbon well over the period of interest;

determining, based on the measurements of wellhead production rate, observed constant wellhead production rates, each of the observed constant wellhead production rates comprising a constant wellhead production rate of the well that occurs at least a threshold number of times over the period of interest;

determining, for each occurrence of a constant wellhead production rate of the observed constant wellhead production rates:

a wellhead pressure for the occurrence of the constant wellhead production rate; and a cumulative production volume comprising a total production of the well at the occurrence of the constant wellhead production rate;

determining, for each of the observed constant wellhead production rates, a depletion rate comprising a slope of a best fit line through points of wellhead pressure versus cumulative production volume for each occurrence of a constant wellhead production rate of the observed constant wellhead production rate, the depletion rate being indicative of a change in wellhead pressure of the well as a function of production volume of the well at the observed constant wellhead production rate;

determining a depletion rate for the well comprising an average of the depletion rates for the observed constant wellhead production rates, the depletion rate for the well being indicative of a change in a wellhead pressure of the well as a function of production volume of the well; and adjusting, based on the depletion rate for the well, a production flow of the well.

20. The method of claim 19, wherein the measurements of wellhead pressure of the hydrocarbon well are obtained by way of a surface pressure sensor, and are measures of a flowing pressure of production flowing through a surface system of the well.

* * * * *